US011643622B2

(12) United States Patent
Cho et al.

(10) Patent No.: US 11,643,622 B2
(45) Date of Patent: *May 9, 2023

(54) LAUNDRY SHEET COMPRISING FUNCTIONAL GRANULES

(71) Applicant: LG Household & Health Care Ltd., Seoul (KR)

(72) Inventors: Min-Seok Cho, Daejeon (KR); Mun-Seong Jo, Daejeon (KR); Kyung-On Cha, Daejeon (KR); Jae-Hyun Kim, Daejeon (KR)

(73) Assignee: LG Household & Health Care Ltd.

( * ) Notice: Subject to any disclaimer, the term of this patent is extended or adjusted under 35 U.S.C. 154(b) by 0 days.

This patent is subject to a terminal disclaimer.

(21) Appl. No.: 17/540,764

(22) Filed: Dec. 2, 2021

(65) Prior Publication Data

US 2022/0089985 A1 Mar. 24, 2022

Related U.S. Application Data

(63) Continuation of application No. 16/063,071, filed as application No. PCT/KR2016/014803 on Dec. 16, 2016, now Pat. No. 11,220,662.

(30) Foreign Application Priority Data

Dec. 17, 2015 (KR) ..... 10-2015-0180978
May 31, 2016 (KR) ..... 10-2016-0067653

(51) Int. Cl.
*C11D 17/06* (2006.01)
*C11D 1/14* (2006.01)
(Continued)

(52) U.S. Cl.
CPC ..... *C11D 17/06* (2013.01); *C11D 1/29* (2013.01); *C11D 3/10* (2013.01); *C11D 3/3753* (2013.01); *C11D 3/38609* (2013.01)

(58) Field of Classification Search
None
See application file for complete search history.

(56) References Cited

U.S. PATENT DOCUMENTS 4,115,292 A 9/1978 Richardson et al.
4,176,079 A 11/1979 Guerry et al.
(Continued)

FOREIGN PATENT DOCUMENTS

DE 10053329 A1 5/2002
EP 1186650 A1 3/2002
(Continued)

OTHER PUBLICATIONS

Extended European Search Report including Written Opinion for Application No. EP16876073.4 dated May 24, 2019, pp. 1-6.
(Continued)

*Primary Examiner* — Lorna M Douyon
(74) *Attorney, Agent, or Firm* — Lerner David LLP

(57) ABSTRACT

The present invention provides a laundry sheet wherein one or more component selected from a group consisting of a builder, an enzyme, a bleaching agent and a bleach activator is contained as a granule in a laundry film prepared using a laundry detergent component and a film-forming water-soluble polymer. The laundry sheet of the present invention completely dissolves in water and thus does not need to be removed after laundering. In addition, the laundry sheet of the present invention has superior cleaning performance, is convenient to use and has superior storage stability.

9 Claims, 2 Drawing Sheets

(51) Int. Cl.

| | |
|---|---|
| ***C11D 3/37*** | (2006.01) |
| ***C11D 3/386*** | (2006.01) |
| ***C11D 3/08*** | (2006.01) |
| ***C11D 3/10*** | (2006.01) |
| ***C11D 3/395*** | (2006.01) |
| ***C11D 1/29*** | (2006.01) |

(56) References Cited

U.S. PATENT DOCUMENTS

| | | | | |
|---|---|---|---|---|
| 4,532,063 | A | 7/1985 | Gueldenzopf | |
| 4,605,509 | A | 8/1986 | Corkill et al. | |
| 6,818,606 | B1 | 11/2004 | Hanada et al. | |
| 11,220,662 | B2 * | 1/2022 | Cho | C11D 3/3753 |
| 2002/0013251 | A1 | 1/2002 | Hayashi et al. | |
| 2006/0258553 | A1 | 11/2006 | Catalfamo et al. | |
| 2007/0269651 | A1 | 11/2007 | Denome et al. | |
| 2011/0028374 | A1 | 2/2011 | Fossum et al. | |
| 2011/0039985 | A1 | 2/2011 | Patel et al. | |
| 2011/0136719 | A1 | 6/2011 | Jalbert et al. | |
| 2012/0151684 | A1 * | 6/2012 | Brooker | C11D 17/0039 8/137 |
| 2013/0273277 | A1 | 10/2013 | Lee et al. | |

FOREIGN PATENT DOCUMENTS

| | | | |
|---|---|---|---|
| JP | S58135794 | A | 8/1983 |
| JP | H1072593 | A | 3/1998 |
| JP | 2000096095 | A | 4/2000 |
| JP | 2000169896 | A | 6/2000 |
| JP | 2011-116430 | A | 6/2011 |
| JP | 2015520701 | A | 7/2015 |
| KR | 19990030414 | A | 4/1999 |
| KR | 2004-0067668 | A | 7/2004 |
| KR | 20100090122 | A | 8/2010 |
| KR | 2010-0107284 | A | 10/2010 |
| KR | 20100107283 | A | 10/2010 |
| KR | 2012-0021449 | A | 3/2012 |
| KR | 20120127175 | A | 11/2012 |
| KR | 2013-0124261 | A | 11/2013 |
| KR | 2014-0100129 | A | 8/2014 |
| KR | 20140102458 | A | 8/2014 |
| WO | 03031637 | A1 | 4/2003 |
| WO | 2015086692 | A1 | 6/2015 |

OTHER PUBLICATIONS

International Search Report From PCT/KR2016/014803 dated Apr. 19, 2017.

* cited by examiner

LAUNDRY SHEET COMPRISING FUNCTIONAL GRANULES

CROSS-REFERENCE TO RELATED APPLICATIONS

This application is a continuation of U.S. application Ser. No. 16/063,071 filed Jun. 15, 2018, now U.S. Pat. No. 11,220,662, a national phase entry under 35 U.S.C. § 371 of International Application No. PCT/KR2016/014803, filed Dec. 16, 2016, which claims priority to Korean Patent Application No. 10-2015-0180978, filed Dec. 17, 2015 and Korean Patent Application No. 10-2016-0067653, filed May 31, 2016, all the disclosures of which are incorporated herein by reference.

TECHNICAL FIELD

The present invention relates to a laundry sheet and a method for preparing the same. Particularly, it relates to a laundry sheet capable of increasing the effects of components contained in the laundry sheet and stabilizing them and a method for preparing the same.

BACKGROUND ART

At present, polymer films are widely used not only in industrial fields such as precision chemical and electronic materials but also in medical and personal care products such as cosmetics, etc. and household articles such as everyday items. Examples of the polymer films used in medical or cosmetic products include a poultice sheet, an adhesive skin patch sheet, etc. wherein a water-insoluble polymer film and a drug are stacked together on a substrate. The polymer film forms a matrix and exhibits a controlled release profile. In everyday items, polymer films are widely used as packaging materials for packaging specific materials and active components separately and thereby providing convenience of use. For example, a polymer film is used as a material for packaging a detergent composition such as a powder detergent and a detergent separately. Korean Patent Publication No. 10-1999-0030414 uses a polyvinyl alcohol film, a gelatin film, a starch film and a cellulose film which are highly soluble in water as a packaging material in order to prevent scattering of a powder detergent and protect water quality by inducing use of an optimum amount. U.S. Pat. No. 4,605,509, Japanese Patent Publication No. S58-135794 and Korean Patent Publication No. 10-2004-0676668 disclose technologies of packaging a liquid detergent and a fabric softener with a water-soluble film.

However, when the water-soluble polymer film is used for separate packaging, the packaged product may leak during storage or transport and the active components may ooze to the film surface. As a result, the storage stability of the product is degraded significantly. In addition, when the water-soluble film is used as a packaging material, it is designed to be stable against moisture in the atmosphere and durable against the content. Due to this, considerable time is required for dissolution at low temperature and the film may remain without being completely dissolved.

To solve these problems, Korean Patent Publication No. 10-2013-0124261 provides a laundry sheet prepared by mixing an active component for laundering such as a detergent in a composition for forming a water-soluble polymer film and then forming a film. However, when the sheet is prepared by removing a solvent such as water from a solution containing a film-forming water-soluble polymer, active components for laundering and the solvent, stability may be decreased as an enzyme, a bleaching agent, etc. among the active components for laundering contained in the laundry sheet are activated and cleaning performance may not be exerted effectively.

DISCLOSURE

Technical Problem

The present invention is directed to providing a laundry sheet which is capable of effectively exerting the effect of one or more active components for laundering selected from a group consisting of a builder, enzyme, a bleaching agent and a bleach activator and a method for preparing the same.

Technical Solution

The present invention provides a laundry sheet prepared using a laundry detergent component and a film-forming water-soluble polymer, wherein one or more component selected from a group consisting of a builder, an enzyme, a bleaching agent and a bleach activator is contained as a granule.

In the present invention, the one or more component selected from a group consisting of a builder, an enzyme, a bleaching agent and a bleach activator may be specifically a component which exerts an effect by being activated together with water.

Hereinafter, the present invention is described in more detail.

The present invention provides a laundry sheet prepared using a laundry film prepared by removing a solvent from a solution containing a film-forming water-soluble polymer and the solvent. A laundry sheet wherein the active component for laundering is distributed in the laundry sheet in the form of a granule without being dissolved is provided. The laundry sheet may be solidified while maintaining a predetermined shape.

The inventors of the present invention have completed the present invention in order to solve the problem that the active component for laundering is activated during preparation of the laundry sheet, making it difficult to exert full effect. It was confirmed that better cleaning effect is achieved when the active component for laundering is contained in the laundry sheet in the form of an undissolved granule.

Definition of Terms

The term "film" used in the present disclosure may be interpreted to mean a thin and flexible membrane or layer. The thickness is not particularly limited and the shape of the film is not particularly limited.

The term "laundry film" used in the present disclosure may be interpreted to mean a film containing i) a laundry detergent component, ii) a laundry softening component, iii) a perfume or iv) two or more of them. Hereinafter, the laundry detergent component may be understood to contain, in addition to the laundry detergent component, a laundry softening component, a perfume or a mixture thereof.

The laundry film may be formed using a solution obtained by mixing a water-soluble polymer for forming the film and a laundry detergent component, although not being limited thereto. The thickness of the laundry film may be identical to that of the film or may be greater or smaller than the thickness of the film. The shape of the laundry film is not particularly limited.

The "film" and the "laundry film" may be formed by completely drying a solution for preparing the film or the laundry film and the solution may be in a semi-dried state. The semi-dried state may mean a state wherein the film maintains the shape of a membrane while containing water to some extent. For example, 70% or more, specifically 80% or more, more specifically 90% or more, of water may have been evaporated from the solution for preparing the film or the laundry film.

The term "sheet" used in the present disclosure may refer to one in which an active component for laundering is distributed on one and/or both sides of a film or a laundry film in order to achieve the purpose of the present invention. For example, the active component for laundering may be one or more component selected from a group consisting of a builder, an enzyme, a bleaching agent and a bleach activator. Specifically, the active component for laundering may be distributed in an undissolved state. That is to say, in the present disclosure, the sheet is used in a meaning distinguished form the film or the laundry film. The sheet of the present invention may contain one laundry film or may be provided as a form in which two or more films are stacked. When the sheet of the present invention contains two or more films, at least one of them is a laundry film. The sheet may be processed to be provided to a consumer and the type of the sheet provided to the consumer is not particularly limited.

The term "distribution" used in the present disclosure means the presence of a specific active component for laundering in the form of a granule (e.g., one or more component selected from a group consisting of a builder, an enzyme, a bleaching agent and a bleach activator) regularly or irregularly in/or a thin film formed from a film-forming water-soluble polymer to have a predetermined tensile strength.

DETAILED DESCRIPTION OF INVENTION

In an exemplary embodiment, the present invention provides a laundry sheet wherein one or more component selected from a group consisting of a builder, an enzyme, a bleaching agent and a bleach activator is contained as a granule in a laundry film prepared using a laundry detergent component and a film-forming water-soluble polymer.

In a specific exemplary embodiment of the present invention, the laundry sheet may be prepared by a method including:

(S1) a step of preparing a solution for preparing a laundry film by dissolving a film-forming water-soluble polymer and a laundry detergent component;

(S2) a step of forming a laundry film with the solution prepared in the step (S1); and (S3) a step of adding one or more component selected from a group consisting of a builder, an enzyme, a bleaching agent and a bleach activator in an undissolved state to the laundry film prepared in the step (S2).

In the step (S1), the aggregated polymer chain of the film-forming water-soluble polymer is disentangled. In the step (S3), the active component for laundering in an undissolved state, e.g., one or more component selected from a group consisting of a builder, an enzyme, a bleaching agent and a bleach activator, is distributed between the polymer chain.

In the step (S3), the one or more component selected from a group consisting of a builder, an enzyme, a bleaching agent and a bleach activator is added in an 'undissolved state'. The term 'undissolved state' includes not only that 100% of the component is undissolved but also that the component is partly dissolved. The term 'partly dissolved' means that 10% or less, 9% or less, 8% or less, 7% or less, 6% or less, 5% or less, 4% or less, 3% or less, 2% or less or 1% or less, specifically 5% or less, of the component is dissolved.

In the present invention, one or more component selected from a group consisting of a builder, an enzyme, a bleaching agent and a bleach activator is added in the form of a granule to be added in an undissolved state.

In the step (S2), a laundry film is formed using the solution of the step (S1). The one or more component selected from a group consisting of a builder, an enzyme, a bleaching agent and a bleach activator may be added to the laundry film in an undissolved state, e.g. in the form of a granule. The type of the granule is not limited as long as it remains undissolved in the laundry sheet In another exemplary embodiment of the present invention, the laundry sheet may be prepared by further stacking the laundry film prepared in the step (S2). In the step (S3), the laundry film may be further stacked after the one or more component selected from a group consisting of a builder, an enzyme, a bleaching agent and a bleach activator is distributed on one or both sides of the film in an undissolved state. The further stacked laundry film may be replaced with a film.

The inventors of the present invention have first identified that, when the granule containing the active component for laundering remains on the sheet surface without completely including inside the sheet, the functionality of the laundry sheet may decrease as the granule particle is detached from the sheet during storage and transport. In addition, it was confirmed that, in that case, a component that can cause skin irritation when the functional granule directly contacts with skin may be exposed to the body part of a user. To prevent this, the film or the laundry film may be further stacked on the laundry sheet of the present invention.

Specifically, the method may further include (S4) a step of preparing a film with a film-forming water-soluble polymer. The film prepared in the step (S4) may be prepared with the same film-forming water-soluble polymer as that used to prepare the film of the step (S2) or a different film-forming water-soluble polymer. The film of the step (S4) may or may not contain a laundry detergent component.

The method may further include (S5) a step of attaching the film (or laundry film) of the step (S4) to the film of the step (S3) in the state where the one or more component selected from a group consisting of a builder, an enzyme, a bleaching agent and a bleach activator is undissolved.

The film (or laundry film) of the step (S3) on which the one or more component selected from a group consisting of a builder, an enzyme, a bleaching agent and a bleach activator is distributed in an undissolved state may be referred to as a first film and the film (or laundry film) added newly onto the first film may be referred to as a second film.

Specifically, the film added in the step (S5) may have the same area as the film prepared in the step (S2), although the size is not limited thereto.

In the step (S5) of attaching the film, two sheets of the film may be stacked and then bonded together. The bonding may be achieved by using an adhesive, heat, ultrasonic waves, etc., although not being particularly limited thereto. The bonding method is not specially limited as long as the one or more component selected from a group consisting of a builder, an enzyme, a bleaching agent and a bleach activator can remain undissolved between the films.

In an exemplary embodiment, the present invention provides a laundry sheet prepared by the method for preparing a laundry sheet of the present invention.

In another exemplary embodiment of the present invention, the laundry sheet may be prepared by stacking three sheets of the film (or laundry film) such that the component in the form of a granule remains undissolved between the films. For example, the laundry sheet shown in FIG. 4 may be provided.

Specifically, the preparation method may include a drying step. The reaction condition of the drying step may vary depending on the process condition. The temperature of a drying furnace may be 40-120° C., drying time may be 5-30 minutes and drying speed may be 1-10 m/min. Specifically, the temperature of the drying furnace may be 60-110° C., the drying time may be 5-20 minutes and the drying speed may be 1-10 m/min.

Specifically, in the present invention, when the one or more component selected from a group consisting of a builder, an enzyme, a bleaching agent and a bleach activator is added as a granule, it is necessary to control the water content of the film (or laundry film) below a predetermined level in order to prevent it from being dissolved in the film (or laundry film).

Specifically, the water content may be 30 wt % or less based on the total weight of the film (or laundry film), although not being limited thereto.

Accordingly, the one or more component selected from a group consisting of a builder, an enzyme, a bleaching agent and a bleach activator is added as a granule and the granule may be added any time, e.g., before, during or after the drying, as long as it remains undissolved after the film (or laundry film) is prepared.

The film-forming water-soluble polymer used in the laundry sheet according to the present invention may be one or more selected from natural, semi-synthetic and synthetic polymers.

As the natural polymer, gelatin, pectin, dextran, hyaluronic acid or a salt thereof, collagen, agar, a gum such as gum arabic, xanthan gum, gum acacia, gum karaya, gum tragacanth and guar gum, carrageenan, alginic acid, sodium alginate, etc. may be used.

As the semi-synthetic polymer, methyl cellulose, ethyl cellulose, hydroxyethyl cellulose, sodium carboxymethyl cellulose, soluble starch, dextrin, carboxymethyl starch, dialdehyde starch, etc. may be used.

As the synthetic polymer, a widely known synthetic polymer such as polyvinyl alcohol, polyvinylpyrrolidone, polyvinyl methacrylate, polyacrylic acid and a salt thereof, polyethylene oxide, a carboxyl-containing acryl resin, a carboxyl-containing polyester resin, water-soluble polyamide, water-soluble polyurethane, maltodextrin and polydextrose or a water-soluble synthetic polymer prepared from a radical-polymerizable monomer may be selected. The polymer synthesized from the radical-polymerizable monomer may be a homopolymer or a copolymer of an ionic monomer and a nonionic monomer.

As a specific example, the film-forming water-soluble polymer may be polyvinyl alcohol (PVA). Specifically, polyvinyl alcohol having a degree of saponification of 75-95% and an average degree of polymerization of 100-3000 may be used to ensure solubility. If the degree of saponification is below 75% or exceeds 95%, it does not dissolve well in water due to low solubility. And, if the average degree of polymerization is below 100, it is not easy to form a film because the molecular weight is too small and the physical properties of the film such as tensile strength, etc. are unsatisfactory. If the average degree of polymerization exceeds 3000, water solubility is poor after film formation because the molecular weight is too large.

The film-forming water-soluble polymer may be contained in an amount of 5-80 wt %, specifically 10-60 wt %, more specifically 20-50 wt %, based on the total weight of the film (or laundry film) after the drying. If the content of the water-soluble polymer is lower than 5 wt %, it is difficult to form the film (or laundry film) because the tensile strength of the laundry sheet is too weak. If the content is higher than 80 wt %, the performance of the laundry sheet is decreased because the content of the active component is decreased relatively and the economic cost is increased due to the increased content of the water-soluble polymer.

Meanwhile, in the laundry sheet according to the present invention, the 'water solubility' of the film-forming water-soluble polymer may be defined under the following measurement condition.

After adding a predetermined amount (5 g) of the film prepared with the film-forming polymer to 500 mL of water and stirring on a magnetic stirrer set to 500 rpm for 10 minutes, the prepared film solution is filtered through filter paper with a maximum pore size of 10 μm, water is dried from the collected filtrate and the weight of the residual material is measured. If the weight is 70% or larger, specifically 80% or larger, more specifically 90% or larger, as compared to the initial weight of the film, the film-forming polymer is defined as a film-forming water-soluble polymer.

A film-forming water-dispersible polymer is also included in the scope of the film-forming water-soluble polymer of the present invention.

In the present disclosure, the term 'water dispersibility' has the following meaning. After adding a predetermined amount (5 g) of a film to 500 mL of water and stirring on a magnetic stirrer set to 500 rpm for 10 minutes, the prepared film solution is filtered through filter paper with a pore size of 10 μm, water is dried from the collected filtrate and the change in weight is measured. If the weight change is 30% or smaller, specifically 20% or smaller, more specifically 10% or smaller, as compared to the initial weight of the film, the film-forming polymer is defined as a film-forming water-dispersible polymer.

Although the film-forming water-soluble polymer used in the present invention has a film-forming property of forming a film matrix, the entangled polymer chain of the film-forming water-soluble polymer in the laundry sheet is disentangled again by a solvent during cleaning. That is to say, the film-forming water-soluble polymer is of a polymer chain type. When solidified, the polymer chain remains assembled in an entangled state. And, when dissolved in a solvent, the polymer chain is disentangled and another material can be inserted between the polymer chain.

As the solvent used to prepare the laundry sheet according to the present invention, water may be used to dissolve the water-soluble polymer. Although a hydrophilic solvent such as an alcohol may also be used, it is preferred to use water because the solubility of the water-soluble polymer may decrease.

In the present invention, the 'laundry detergent component' may be a generally used anionic surfactant, nonionic surfactant or zwitterionic surfactant and may also be a mixture of two or more of them.

Representative examples of the anionic surfactant may include a carboxylate compound such as soap, a higher alcohol, a higher alkyl ester, a sulfuric ester salt compound obtained from sulfation of an olefin, an alkylbenzenesulfonate, a sulfate compound including a lauryl sulfate salt and a phosphate compound obtained from phosphorylation of a higher alcohol.

For example, laurylbenzenesulfonic acid, an α-olefin sulfonate, sodium lauryl sulfate, ethoxylated sodium lauryl sulfate, a secondary alkanesulfonate, methyl ester sulfonate, etc. may be used alone or as a mixture of two or more, although not being limited thereto. Specifically, sodium lauryl sulfate may be used as the anionic surfactant.

And, as the nonionic surfactant, a polyoxyalkylene alkyl phenyl ether, a polyoxyalkylene alkyl ether, a polyoxyethylene polyoxypropylene block polymer, a polyethylene glycol fatty acid ester, a polyoxyethylene sorbitan fatty acid ester, cocamidomonomethylamine, cocamidodimethylamine, cocamidomonoethylamine, a fatty acid alkanolamine, an amine oxide, an alkyl polyglucoside, a methyl polyethylene alkyl ether, a sugar ether, etc. may be used alone or as a mixture of two or more, although not being limited thereto. Specifically, a polyoxyalkylene alkyl ether represented by Chemical Formula 1 or a polyoxyalkylene alkyl phenylether represented by Chemical Formula 2 may be used.

$$C_m—H_{2m+1}—O—(CH_2CH_2O)_n—H \quad \text{[Chemical Formula 1]}$$

$$C_mH_{2m+1}C_6H_5—O—(CH_2CH_2O)_n—H \quad \text{[Chemical Formula 2]}$$

In Chemical Formula 1 and Chemical Formula 2, m is an integer from 5 to 21 and n is an integer from 1 to 20.

And, as the zwitterionic surfactant, an amine oxide, cocamidopropyl betaine, etc. may be used alone or as a mixture of two or more, although not being limited thereto.

The active components for laundering such as the builder, the enzyme, the bleaching agent, the bleach activator, etc. exert activity by reacting with water. If they are mixed together with the film-forming water-soluble polymer and the laundry detergent component, they are dissolved during the preparation process and exert their activities. As a result, they cannot exhibit their performance when the final product is used.

Accordingly, in the present invention, in order to solve the problem of decreased performance of a specific active component for laundering which exerts activity by reacting with water in the water-soluble polymer film, the active component for laundering prepared into a granule form is applied to the laundry sheet and/or the composition for preparing the laundry sheet. That is to say, in the present invention, the active component for laundering prepared into a granule form is present between the polymer chain of the laundry sheet in an undissolved state.

That is to say, the present invention provides a laundry sheet prepared using a laundry detergent component and a film-forming water-soluble polymer, wherein one or more component selected from a group consisting of a builder, an enzyme, a bleaching agent and a bleach activator is added as a granule.

Specifically, in the present invention, when the one or more component selected from a group consisting of a builder, an enzyme, a bleaching agent and a bleach activator is added as a granule, the water content of the film (or laundry film) should be below a predetermined level so that the component is not dissolved in the film (or laundry film) and not activated before cleaning. The water content may be specifically 30 wt % or lower based on the total weight of the film, although not being limited thereto.

The inventors of the present invention have found out that, whereas the components cannot exert their performance in the final product if they are mixed in a water-soluble polymer solution during the preparation of a laundry sheet because their activity is exerted during laundry sheet preparation process, they can fully exert their performance if they are added in the laundry sheet and/or the composition for preparing the laundry sheet in an undissolved state and have completed the present invention.

In the present invention, the granule is not limited to any shape. That is to say, it is not limited in shape as long as the components remain undissolved in the laundry sheet and is not specially limited in size. That is to say, the granule includes any one with irregular shape and size, commonly called a particle, a powder, a grain, etc.

In the present invention, the granule is an assemblage of an amorphous particle with no predetermined shape. In the present disclosure, the granules of different sizes are represented by an average particle diameter.

In the present invention, the shape of the granule may be a spherical shape, a cylindrical shape, a splinter shape or a combination thereof, although not being limited thereto.

It is obvious to those of ordinary skill in the art that the 'spherical shape' includes a shape which is not a perfect sphere. That is to say, it includes a shape whose transverse and/or longitudinal cross section is an ellipse rather than a perfect circle and also includes a shape whose contour is regularly or irregularly uneven rather than smoothly curved.

In the present disclosure, the term "average particle diameter" means a particle size measured using a laser particle size analyzer. In the particle size distribution measurement, the determined diameter of the particle is an imaginary equivalent diameter. When one of the measured physical properties of a particle is similar to that of a sphere having a particular dimeter, this diameter is referred to as the equivalent diameter of the particle. The laser particle size analyzer measures the particle size using scattering property and the measured diameter is an equivalent scattering diameter. That is to say, it is the diameter of a sphere exhibiting the same scattering property.

In the present invention, the average particle diameter of the granule may be 0.1-5 mm, specifically 0.3-3 mm, more specifically 0.5-2 mm.

In the present invention, the component that may be added in the form of a granule may include a builder, an enzyme, a bleaching agent, a bleach activator, a sterilizer/disinfectant, a perfume, etc., although not being limited thereto.

The term "builder" used in the present disclosure means a hard water softener. The builder refers to a material which sequesters ions such as calcium, magnesium, etc. in hard water by precipitating, removing through ion exchange or forming a chelate, although not being limited thereto. That is to say, the builder exerts its effect by being activated upon reaction with water.

When the builder is added to a water-soluble polymer solution in the form of a powder during the preparation of a laundry sheet as in the existing technology, the builder may be activated by water contained in the water-soluble polymer solution during the preparation of a sheet and, therefore, may not fully exert its effect during cleaning. And, for PVA, it is difficult to prepare the sheet due to gelation and salting out and solubility may decrease. In order to solve this problem, the builder is added to the laundry sheet in an undissolved state in the present invention. Then, a large portion of the builder is activated during cleaning and, therefore, significantly superior cleaning performance is achieved as compared to when it is added to a water-soluble polymer solution (see Table 3). In addition, sheet-forming property is superior and the builder does not ooze to the surface (see Table 2).

Specifically, the builder that may be used in the present invention may be an alkaline builder. One or more selected from a group consisting of sodium hydroxide, sodium carbonate, sodium bicarbonate, sodium metasilicate, alkaline sodium silicate, neutral sodium silicate, sodium tripolyphosphate, sodium pyrophosphate, sodium borate, zeolite (sodium aluminosilicate), sodium sesquicarbonate, MEA (monoethanolamine) and TEA (triethanolamine) may be used, although not being limited thereto.

The term "enzyme" used in the present disclosure means an enzyme that can be used for cleaning. For example, one or more selected from a group consisting of protein-degrading enzyme (e.g., protease, etc.), a lipid-degrading enzyme (e.g., lipase, etc.), carbohydrate-degrading enzyme (e.g., amylase, etc.), cellulose-degrading enzyme (e.g., cellulase, etc.), mannan-degrading enzyme (e.g., mannanase) and a pectin-degrading enzyme (e.g. pectinase) may be used.

In general, when the enzyme is added to the water-soluble polymer solution in the form of a powder during the preparation of a laundry sheet, the enzyme included in the sheet may be denatured due to the drying at high temperature, which is essential in the preparation process of the laundry sheet. As a result, the cleaning performance of the laundry sheet may decrease due to decreased activity of the enzyme.

In order to solve this problem, the enzyme is added in the form of a granule in the present invention. Then, the activity of the enzyme is not decreased during the use of the sheet even after drying at high temperature for a predetermined time (see Table 3). In addition, sheet-forming property is superior and the enzyme does not ooze to the surface (see Table 2).

In the present invention, as the "bleaching agent", one commonly used in cleaning may be used. For example, a perborate, a percarbonate (e.g., sodium percarbonate), a perphosphate, a persulfate, a persilicate, etc. may be used as an inorganic bleaching agent and an organic peroxyacid including diacyl and tetraacyl peroxide may be used as an organic bleaching agent, although not being limited thereto.

Also, in the present invention, as the "bleach activator" one commonly used in cleaning may be used. For example, one or more selected from a group consisting of tetraacetylethylenediamine (TAED), benzoylcaprolactam (BzCL), 4-nitrobenzoylcaprolactam, 3-chlorobenzoylcaprolactam, benzoyloxybenzenesulfonate (BOBS), nonanoyloxybenzenesulfonate (NOBS), phenyl benzoate (PhBz), decanoyloxybenzenesulfonate ($C_{10}$-OBS), benzoylvalerolactam (BZVL), octanoyloxybenzenesulfonate ($C_8$-OBS) and hydrolytic ester may be used, although not being limited thereto.

When the bleaching agent and/or the bleach activator is added to a water-soluble polymer solution in the form of a powder during the preparation of a laundry sheet as in the existing technology, they may be activated by water contained in the water-soluble polymer solution during the preparation of a sheet and, therefore, may not fully exert their effect during cleaning. In order to solve this problem, the bleaching agent and/or the bleach activator is in an undissolved state in the present invention. Then, a large portion of the bleaching agent and/or the bleach activator is activated during cleaning and, therefore, provides significantly superior bleaching performance as compared to when it is added to the water-soluble polymer solution (see Table 3). In addition, sheet-forming property is superior and the bleaching agent and/or the bleach activator does not ooze to the surface (see Table 2).

In the present invention, as the "sterilizer/disinfectant", one commonly used in cleaning may be used. For example, sodium hypochlorite, hydrogen peroxide, urea peroxide, sodium dichloroisocyanurate ($NaCl_3(CON)_3$), potassium sulfate ($(KHSO_5)_2KHSO_4K_2SO_4$), calcium peroxide, sodium tripolyphosphate, sodium acid pyrophosphate, etc. may be used, although not being limited thereto.

When these components are prepared into a granule, they may be prepared into a granule either alone or in combination with two or more.

The laundry sheet according to the present invention may further contain a fabric softener, a dispersant, an emulsifier, etc. in addition to the above-described components.

More specifically, the laundry sheet according to the present invention may contain a quaternary ammonium salt-based cationic surfactant as the fabric softener. For example, one or more selected from a dialkyl dimethyl ammonium chloride represented by Chemical Formula 3, a dialkyl imidazolinium salt represented by Chemical Formula 4, a dialkylamido quaternary ammonium salt represented by Chemical Formula 5, an ester-quat, etc. may be used.

[Chemical Formula 3]

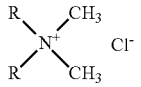

[Chemical Formula 4]

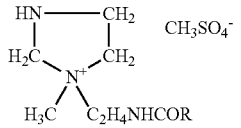

[Chemical Formula 5]

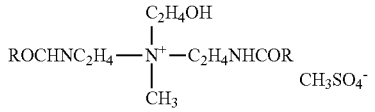

In Chemical Formulas 3, 4 and 5, each R is independently a $C_1$-$C_{30}$ linear or branched, saturated or unsaturated alkyl hydrocarbon.

As the fabric softener, a natural or synthetic cationic polymer may be used. For example, one or more selected from cationic guar such as guar hydroxypropyltrimonium chloride, hydroxypropyl guar hydroxypropyltrimonium chloride, etc., cellulose (Polyquaternium-10), polyquaternium series, a dimethyl diallyl ammonium chloride polymer, an acrylamide-dimethyl diallyl ammonium copolymer, a polyvinylpyrrolidone (PVP)-dimethylaminoethyl methacrylate copolymer, an acrylic acid-dimethyl diallyl ammonium chloride copolymer, an acrylamide-dimethylaminoethyl methacrylate methyl chloride copolymer, a trimethylaminoethyl methacrylate polymer, etc. may be used, although not being limited thereto.

Also, the laundry sheet of the present invention may contain a dispersant. For example, the dispersant helps the water-soluble polymer to be uniformly mixed with the active component for laundering such as the cationic surfactant and improves water dispersibility of the active component for laundering during the dissolution of the film.

The laundry sheet according to the present invention may contain a nonionic surfactant as the emulsifier. For example, one or more selected from a polyoxyalkylene alkyl phenyl ether, a polyoxyalkylene alkyl ether, a polyoxyethylene polyoxypropylene block polymer, a polyethylene glycol fatty acid ester, a polyoxyethylene sorbitan fatty acid ester, etc. may be used.

The content of the emulsifier may be 0-40 wt %, specifically 1-20 wt %, more specifically 1-10 wt %, based on the total weight of the film after drying. If the content of the emulsifier exceeds 40 wt %, flexibility may decrease because the amount of the fabric softener, etc. adsorbed to a fabric is decreased remarkably.

Specifically, an emulsifier with an HLB value of 2-18 may be used. This emulsifier makes it easier to prepare the sheet and allows all the active components contained in the prepared sheet to be released to and dispersed in water during cleaning. More specifically, an emulsifier with an HLB value of 8-12 may be used in this aspect. The HLB refers to the hydrophilic-lipophilic balance.

The laundry sheet according to the present invention may further contain a perfume, an preservative, a stabilizer, a pigment or an antimicrobial agent in addition to these components.

The laundry sheet according to the present invention may have a tensile strength of specifically 0.5-15 kgf/cm$^2$, more specifically 1-12 kgf/cm$^2$. If the tensile strength of the laundry sheet is lower than 0.5 kgf/cm$^2$, the laundry sheet may break easily during transport or use. And, if it is higher than 15 kgf/cm$^2$, fast dissolution property may be unsatisfactory.

The laundry sheet according to the present invention may have a thickness of specifically 1 μm to 1 cm, more specifically 5 μm to 0.5 cm. If the thickness of the dried laundry sheet is smaller than 1 μm, an enough amount of the active component cannot be supported, the film strength is decreased and it is difficult to achieve the desired performance. And, if thickness of the dried laundry sheet exceeds 1 cm, fast disintegration property and fast dissolution property are unsatisfactory and it is difficult to obtain a uniform water-soluble film.

Because the laundry sheet according to the present invention is completely dissolved in water after being used, an additional process of removing the laundry sheet is unnecessary. That is to say, the water-soluble polymer forming the matrix of the sheet is removed by being dissolved in water and the component contained therein exerts its effect by being dissolved or dispersed in the water.

In an exemplary embodiment, the present invention provides a multi-layered laundry sheet wherein one or more film or laundry film is stacked to form a multi-layered structure.

In an exemplary embodiment, the present invention provides a laundry sheet wherein a film or a laundry film prepared using a film-forming water-soluble polymer is further stacked on one or both sides of the laundry sheet.

In addition, the present invention provides a laundry product containing the laundry sheet according to the present invention. The laundry product may include the laundry sheet according to the present invention itself and a laundry pouch, a laundry bag, a laundry envelope, etc. containing the laundry sheet according to the present invention. The laundry pouch, laundry bag, laundry envelope, etc. may be prepared such that it contains two or more laundry sheets according to the present invention and an inner space is formed, so that a desired material is added in the inner space, such that the sheet can exert its effect as it is dissolved or after it is dissolved.

Advantageous Effects

The present invention provides a laundry sheet which is completely dissolved in water and, thus, is not necessary to be removed after cleaning.

The laundry sheet of the present invention exhibits superior cleaning performance and is convenient to use. In addition, the laundry sheet has superior storage stability.

The laundry sheet of the present invention, which contains a component exerting an effect by reacting with water in the form of a granule, can provide a more superior cleaning effect during cleaning.

DESCRIPTION OF DRAWINGS

The accompanying drawings illustrate a preferred embodiment of the present disclosure and together with the foregoing disclosure, serve to provide further understanding of the technical features of the present disclosure, and thus, the present disclosure is not construed as being limited to the drawing.

DESCRIPTION OF MAIN ELEMENTS

Figure 1:
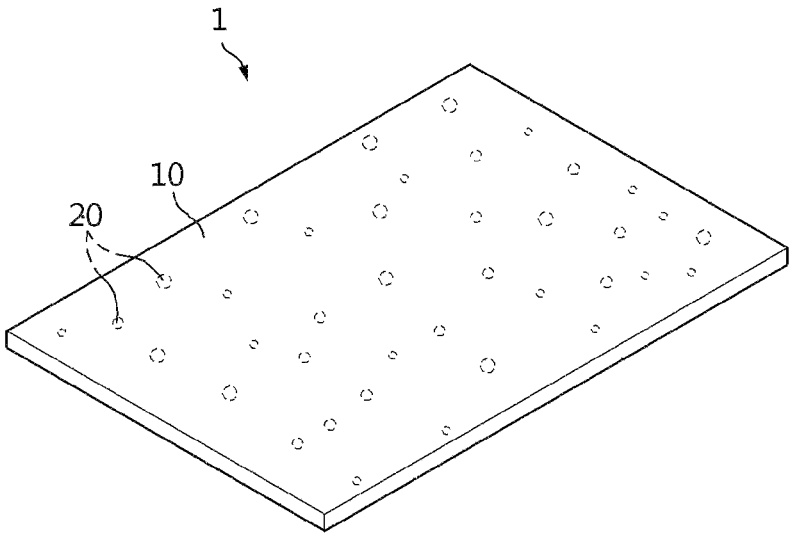
FIG. 1 schematically shows an exemplary embodiment of a laundry sheet containing an active component for laundering in an undissolved state (granule form).
Figure 2:
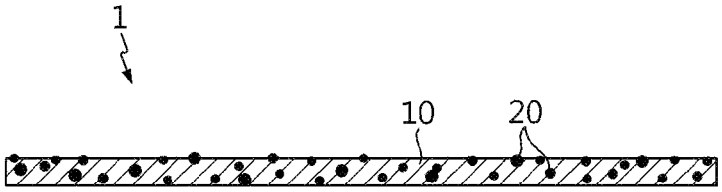
FIG. 2 schematically shows an exemplary embodiment of a laundry sheet containing an active component for laundering in an undissolved state (granule form), wherein the granule protrudes from the surface of the laundry sheet.
Figure 3:
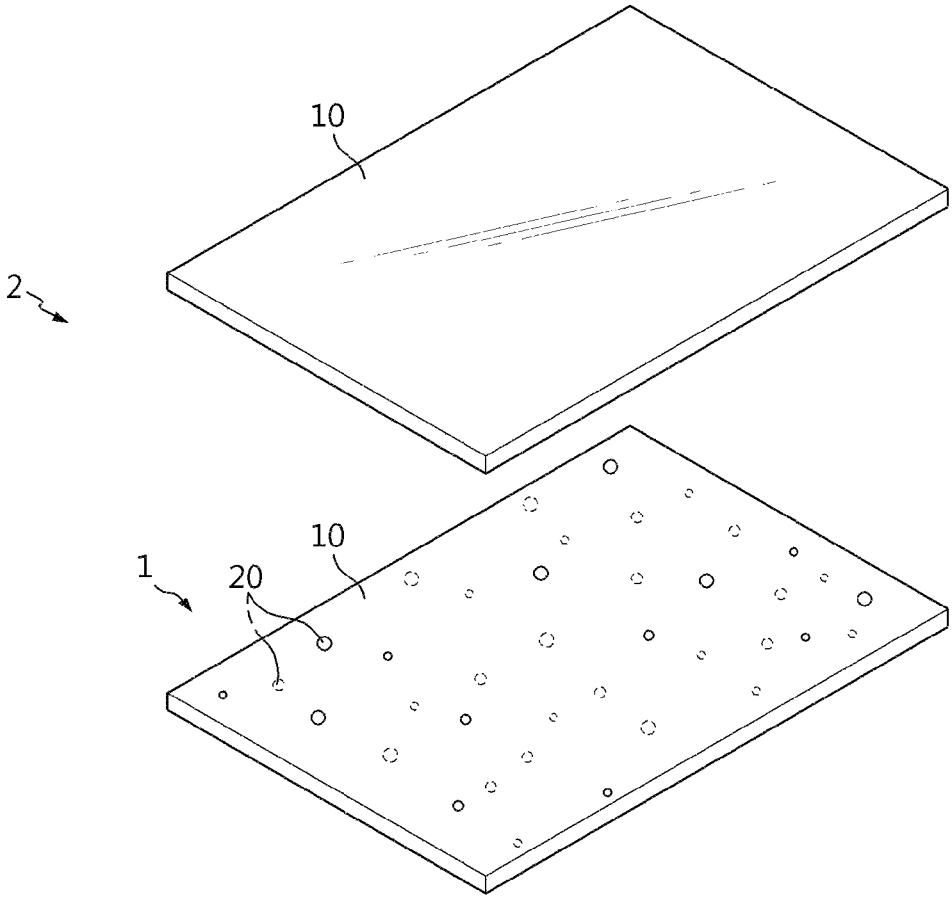
FIG. 3 schematically shows an exemplary embodiment of a laundry sheet in which two sheets of a film prepared according to an exemplary embodiment of the present invention are stacked. Specifically, a laundry sheet 2 is shown wherein a film is further attached to a laundry sheet in which an active component for laundering in an undissolved state (granule form) is distributed on a first film 10. In the laundry sheet 2 shown in FIG. 3, the active component for laundering exists in an undissolved state between the films. One or more of the films constituting the sheet 2 may be a laundry film.
Figure 4:
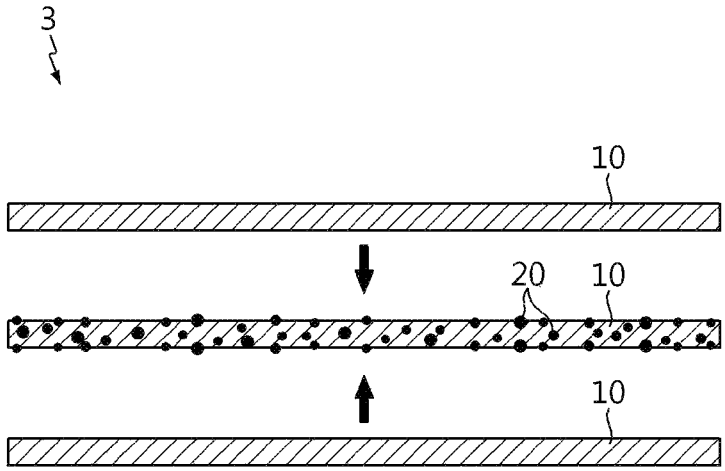
FIG. 4 schematically shows an exemplary embodiment of a laundry sheet 3 in which three sheets of a film prepared according to an exemplary embodiment of the present invention are stacked.

1: laundry sheet
2: laundry sheet in which two sheets of a film are stacked, as an exemplary embodiment
3: laundry sheet in which three sheets of a film are stacked, as an exemplary embodiment
10: film containing water-soluble polymer
20: active component for laundering

MODE FOR DISCLOSURE

Hereinafter, embodiments of the present disclosure will be described in detail to help understanding of the present disclosure. However, various modifications and changes could be made to the embodiments of the present disclosure, and it should be understood that the scope of the disclosure is not limited to the following embodiments. The embodiments of the present disclosure are provided to persons having an ordinary skill in the art for more complete description of the present disclosure.

PREPARATION EXAMPLES

Comparative Examples 1-3

A 20 wt % PVA solution was prepared by adding 200 g of PVA (degree of saponification: 86.5%, average degree of polymerization: 500) to 800 g of distilled water and dissolving at 80° C. for 4 hours. After adding the active components described in Table 1 to the prepared PVA solution, they were dissolved by mixing with a mechanical stirrer. After loading the prepared PVA solution onto a release film, a film with a predetermined thickness was prepared using a film applicator (Elcometer). Then, a laundry sheet (thickness: 0.01 cm) was prepared by drying in a drying oven at 105° C. for 10 minutes.

Examples 1-3

A 20 wt % PVA solution was prepared by adding 200 g of PVA (degree of saponification: 86.5%, average degree of polymerization: 500) to 800 g of distilled water and dissolving at 80° C. for 4 hours. After loading the prepared solution onto a release film, a film with a predetermined thickness was prepared using a film applicator (Elcometer). Then, after spreading active components in the form of a granule onto the sheet, a laundry sheet (thickness: 0.01 cm) containing the active components was prepared by drying in a drying oven at 105° C. for 10 minutes.

TABLE 1

| | | Examples | | | Comparative Examples | | |
|---|---|---|---|---|---|---|---|
| (Unit: wt %) | | 1 | 2 | 3 | 1 | 2 | 3 |
| Polymer matrix | PVA(1) | 40 | 40 | 40 | 40 | 40 | 40 |
| Active components (dissolved in sheet) | Surfactant(2) | 48 | 48 | 48 | 48 | 48 | 48 |
| | Builder(3) | — | — | — | 10 | — | — |
| | Enzyme(4) | — | — | — | — | 10 | — |
| | Bleach component(5) | — | — | — | — | — | 10 |
| Granular active components | Builder(3) | 10 | — | — | — | — | — |
| | Enzyme(4) | — | 10 | — | — | — | — |
| | Bleach component(5) | — | — | 10 | — | — | — |
| Additives | Perfume and others | 2 | 2 | 2 | 2 | 2 | 2 |
| Total | 100 | 100 | 100 | 100 | 100 | 100 | 100 |

(Note)
PVA(1): polyvinyl alcohol, degree of saponification: 86.5%, average degree of polymerization: 500
Surfactant(2): SLS (sodium lauryl sulfate)
Builder(3): sodium carbonate
Enzyme(4): protein-degrading enzyme (Savinase, Novozymes)
Bleach component(5): sodium percarbonate <Test Example>Evaluation of Sheet-Forming Property and Performance The sheet-forming property and performance of the laundry sheets prepared in Examples 1-3 and Comparative Examples 1-3 were evaluated by the methods described below. For the performance evaluation, cleaning performance for contaminated fabric according to the Japan Laundry Science Association, cleaning performance for protein-contaminated fabric and bleaching performance for tea-contaminated fabric were evaluated.

(Evaluation of Sheet-Forming Property)

The sheet-forming property of the PVA film sheets prepared in Examples 1-3 and Comparative Examples 1-3 was evaluated through visual inspection. The result is given in Table 2.

◎: Sheet formulation is flexible and excellent without oozing.

O: Sheet formulation is flexible but a liquid component slightly oozes out.

Δ: Sheet flexibility is insufficient and slight oozing occurs.

X: Sheet formulation fails, and much liquid component oozes out.

TABLE 2

| | Examples | | | Comparative Examples | | |
|---|---|---|---|---|---|---|
| | 1 | 2 | 3 | 1 | 2 | 3 |
| Sheet-forming property | ◎ | ◎ | ◎ | X | ○ | Δ |

As seen from Table 2, Examples 1-3 showed superior sheet-forming property, whereas Comparative Examples 1-3 showed decreased sheet-forming property as the contents of the active components dissolved in the sheets were increased. In particular, sheet formation failed when the builder component was mixed in the form of a liquid as in Comparative Example 1.

(Evaluation of Cleaning Performance)

Cleaning performance was evaluated using a washing machine of the same condition and tap water. Cold tap water was used for the cleaning. A wet artificially contaminated fabric prepared according to the Japan Laundry Science Association and the protein-contaminated fabric EMPA 116 were used to evaluate cleaning performance. Also, a tea-contaminated fabric BC3 was used to evaluate bleaching performance. The evaluation was conducted by attaching the contaminated fabric to a cotton T-shirt. Also, a comparative evaluation was conducted by a statistical method using 16 pieces of contaminated fabrics having a size of 5 cm×5 cm. In this instance, the WB value representing a whiteness index of the contaminated fabric was measured using a color difference meter before and after the cleaning. The laundry sheet prepared in each example was cut to a size of 20 cm×15 cm, and 2 pieces of a detergent were used. At the beginning of cleaning, the laundry sheet and the detergent were put into a washing machine together with the contaminated fabrics, cleaning was done under the conditions of a standard program (cleaning for 20 minutes, rinsing twice) of the washing machine and a middle water level, and after dehydration, the contaminated fabrics were dried in a constant temperature and humidity room (25° C., 20% RH) for a week and then ironed. Then the WB value was measured using the same color difference meter. The cleaning performance was calculated from the obtained result using the Kubelka-Munk equation expressed by Equation 1. The result is given in Table 3.

Cleaning performance (%) = [Equation 1]

$$\frac{[(1-R_s^2)/2R_s-(1-R_c^2)/2R_c]}{[(1-R_s^2)/2R_s-(1-R_o^2)/2R_o]}\times 100$$

In Equation 1, $R_s$ denotes the surface reflectivity of the contaminated fabric, $R_c$ denotes the surface reflectivity of the contaminated fabric after the cleaning process, and $R_o$ denotes the surface reflectivity of the white cotton fabric.

TABLE 3

| | Examples | | | Comparative Examples | | |
|---|---|---|---|---|---|---|
| Cleaning performance (%) | 1 | 2 | 3 | 4 | 5 | 6 |
| Contaminated fabric prepared (Japan Laundry Science Association) | 73 | 67 | 70 | 59 | 58 | 58 |
| Protein-contaminated fabric (EMPA116) | 68 | 75 | 63 | 42 | 42 | 22 |
| Tea-contaminated fabric (BC3) | 75 | 71 | 83 | 43 | 35 | 35 |

As seen from Table 3, Examples 1-3 wherein the active components were added in the form of a granule showed superior cleaning performance.

INDUSTRIAL APPLICABILITY

The present invention provides a laundry sheet which is completely dissolved in water and, thus, is not necessary to be removed after cleaning. The laundry sheet of the present invention exhibits superior cleaning performance and is convenient to use. In addition, the laundry sheet has superior storage stability.

What is claimed is:

1. A laundry sheet comprising:

an active component for laundering, wherein the active component comprises an enzyme, and a laundry film formed by mixing a laundry detergent component and a film-forming water soluble polymer, wherein the laundry detergent component is sodium lauryl sulfate, wherein the active component for laundering is a granule, and the granule is contained and distributed between polymer chains on at least one side of the laundry film, and wherein the film-forming water-soluble polymer is polyvinyl alcohol having an average degree of polymerization of 100-3000.

2. The laundry sheet according to claim 1, wherein the granules are added after the mixing the laundry detergent component and the film-forming water-soluble polymer.

3. The laundry sheet according to claim 1, the active component for laundering further comprise one or more selected from a builder, a bleaching agent or a bleach activator.

4. The laundry sheet according to claim 3, wherein the builder is one or more selected from a group consisting of sodium hydroxide, sodium carbonate, sodium bicarbonate, sodium metasilicate, alkaline sodium silicate, neutral sodium silicate, sodium tripolyphosphate, sodium pyrophosphate, sodium borate, zeolite, sodium sesquicarbonate, monoethanolamine (MEA) and triethanolamine (TEA).

5. The laundry sheet according to claim 1, wherein the enzyme is one or more selected from a group consisting of a protein-degrading enzyme, a lipid-degrading enzyme, a carbohydrate-degrading enzyme, a cellulose-degrading enzyme, a mannan-degrading enzyme and a pectin-degrading enzyme.

6. The laundry sheet according to claim 3, wherein the bleaching agent is one or more selected from a group consisting of a perborate, a percarbonate, a perphosphate, a persulfate, a persilicate and diacyl and tetraacyl peroxide.

7. The laundry sheet according to claim 3, wherein the bleach activator is one or more selected from a group consisting of tetraacetylethylenediamine (TAED), benzoylcaprolactam (BzCL), 4-nitrobenzoylcaprolactam, 3-chlorobenzoylcaprolactam, benzoyloxybenzenesulfonate (BOBS), nonanoyloxybenzenesulfonate (NOBS), phenyl benzoate (PhBz), decanoyloxybenzenesulfonate (C10-OBS), benzoylvalerolactam (BZVL), octanoyloxybenzenesulfonate (C8-OBS) and hydrolytic ester.

8. The laundry sheet according to claim 1, wherein the laundry film is stacked to form a multi-layered structure.

9. The laundry sheet according to claim 1, wherein the laundry detergent component further comprises a nonionic surfactant.

* * * * *